US010597993B2

(12) United States Patent
Saponja et al.

(10) Patent No.: US 10,597,993 B2
(45) Date of Patent: Mar. 24, 2020

(54) ARTIFICIAL LIFT SYSTEM

(71) Applicant: HEAL SYSTEMS LP, Calgary (CA)

(72) Inventors: Jeff Saponja, Calgary (CA); Rob Hari, Calgary (CA); Dean Tymko, Calgary (CA)

(73) Assignee: Heal Systems LP, Calgary (CA)

( * ) Notice: Subject to any disclaimer, the term of this patent is extended or adjusted under 35 U.S.C. 154(b) by 444 days.

(21) Appl. No.: 14/223,722

(22) Filed: Mar. 24, 2014

(65) Prior Publication Data

US 2015/0267519 A1 Sep. 24, 2015

(51) Int. Cl.

| | |
|---|---|
| ***E21B 43/38*** | (2006.01) |
| ***E21B 43/12*** | (2006.01) |
| ***E21B 17/18*** | (2006.01) |

(52) U.S. Cl.

CPC ..... *E21B 43/38* (2013.01); *E21B 17/18* (2013.01); *E21B 43/121* (2013.01); *E21B 43/122* (2013.01)

(58) Field of Classification Search

CPC ..... E21B 43/122; E21B 17/18; E21B 43/121; E21B 41/0078; E21B 43/38

See application file for complete search history.

(56) References Cited

U.S. PATENT DOCUMENTS

| | | | | |
|---|---|---|---|---|
| 1,554,835 | A | 9/1925 | Barrett | 166/105.5 |
| 1,674,815 | A | 6/1928 | Barnhart | 166/105.5 |
| 1,973,650 | A | 9/1934 | O'Brien | 166/105.5 |
| 2,525,233 | A | 10/1950 | Miller | 166/105.5 |
| 2,883,940 | A | 4/1959 | Gibson | 166/105.5 |
| 3,109,490 | A | 11/1963 | Baker | 166/114 |
| 3,182,726 | A | 5/1965 | Stone, Jr. | 166/145 |
| 4,127,168 | A | 11/1978 | Hanson et al. | 166/123 |
| 4,372,393 | A | 2/1983 | Baker | 166/382 |
| 4,383,578 | A | 5/1983 | Baker | 166/373 |
| 4,481,020 | A | 11/1984 | Lee et al. | |
| 4,508,167 | A | 4/1985 | Weinberg et al. | 166/120 |
| 4,513,817 | A | 4/1985 | Weinberg | 166/138 |
| 4,676,308 | A | 6/1987 | Chow et al. | |
| 4,951,746 | A | 8/1990 | Setterberg, Jr. | 166/114 |
| 5,257,665 | A | 11/1993 | Watkins | 166/372 |
| 5,271,725 | A | 12/1993 | Freet et al. | 417/423.3 |
| 5,482,117 | A | 1/1996 | Kolpak et al. | 166/265 |

(Continued)

FOREIGN PATENT DOCUMENTS

| | | |
|---|---|---|
| CA | 2053606 | 4/1992 |
| CA | 2120283 | 10/1995 |

(Continued)

OTHER PUBLICATIONS

International Search Report and Written Opinion issued in PCT/CA2015/000178, dated Jul. 6, 2015.

(Continued)

*Primary Examiner* — Nicole Coy

(74) *Attorney, Agent, or Firm* — Fish & Richardson P.C.

(57) ABSTRACT

There is provided apparati and systems for producing hydrocarbons from a subterranean formation, when reservoir pressure within the subterranean formation is insufficient to conduct hydrocarbons to the surface through a wellbore. The apparati and systems utilize a downhole pump and, in some cases, combine a downhole pump with a gas lift apparatus, in order to effect artificial lift of the hydrocarbons.

5 Claims, 11 Drawing Sheets

(56) References Cited

U.S. PATENT DOCUMENTS

| | | | | |
|---|---|---|---|---|
| 5,535,825 | A | 7/1996 | Hickerson | 166/302 |
| 5,662,341 | A | 9/1997 | Ezell et al. | 277/336 |
| 6,039,121 | A * | 3/2000 | Kisman | E21B 43/121 166/272.7 |
| 6,092,602 | A | 7/2000 | Gano | 166/313 |
| 6,113,675 | A | 9/2000 | Branstetter | |
| 6,119,771 | A | 9/2000 | Gano et al. | 166/50 |
| 6,167,970 | B1 | 1/2001 | Stout et al. | 166/377 |
| 6,547,005 | B2 | 4/2003 | Haheim | 166/265 |
| 6,651,740 | B2 | 11/2003 | Kobylinski et al. | 166/265 |
| 6,672,392 | B2 | 1/2004 | Reitz | 166/372 |
| 6,688,395 | B2 | 2/2004 | Maguire et al. | 166/380 |
| 6,932,160 | B2 * | 8/2005 | Murray | E21B 43/38 166/105.5 |
| 7,100,695 | B2 | 9/2006 | Reitz | 166/372 |
| 7,104,321 | B2 | 9/2006 | Carruth | 166/265 |
| 7,174,959 | B2 | 2/2007 | Pratt | 166/265 |
| 7,776,085 | B2 | 8/2010 | Bernero et al. | 623/2.32 |
| 7,909,092 | B2 | 3/2011 | Cobb | 166/105.1 |
| 8,006,751 | B2 | 8/2011 | Lambert et al. | 166/75.11 |
| 8,006,756 | B2 | 8/2011 | Mazzanti | 166/263 |
| 8,051,907 | B2 | 11/2011 | Cobb | 166/105.1 |
| 8,985,221 | B2 | 3/2015 | Mazzanti | 166/372 |
| 9,022,106 | B1 | 5/2015 | McCoy | 166/105.5 |
| 2005/0081718 | A1 | 4/2005 | Carruth | 96/212 |
| 2006/0113082 | A1 | 6/2006 | Moffett et al. | 166/372 |
| 2007/0246227 | A1 | 10/2007 | Ezell et al. | 166/387 |
| 2009/0194293 | A1 | 8/2009 | Stephenson et al. | 166/372 |
| 2009/0200041 | A1 | 8/2009 | Watson | 166/382 |
| 2010/0258306 | A1 | 10/2010 | Camilleri et al. | 166/265 |
| 2010/0319926 | A1 | 12/2010 | Reid | |
| 2011/0024121 | A1 | 2/2011 | Skeates et al. | 166/308.1 |
| 2011/0100624 | A1 * | 5/2011 | Ford | E21B 43/38 166/265 |
| 2011/0214880 | A1 | 9/2011 | Rogers | 166/372 |
| 2012/0006543 | A1 | 1/2012 | Cox et al. | 166/265 |
| 2012/0227984 | A1 | 9/2012 | Thomson et al. | 166/380 |
| 2013/0032341 | A1 | 2/2013 | Raglin | 166/265 |
| 2013/0068454 | A1 | 3/2013 | Armistead | 166/265 |
| 2013/0133883 | A1 | 5/2013 | Hill, Jr. | 166/250.17 |
| 2013/0153203 | A1 | 6/2013 | Lauderdale | 166/55 |
| 2015/0247390 | A1 | 9/2015 | Mazzanti | 166/372 |

FOREIGN PATENT DOCUMENTS

| | | |
|---|---|---|
| CA | 2781599 | 6/2011 |
| CA | 2823495 | 6/2013 |
| CN | 102369337 | 3/2012 |
| CN | 102859113 | 1/2013 |
| CN | 103180544 | 6/2013 |
| EP | 0 802 303 | 10/1997 |
| RU | 2312985 | 12/2007 |
| WO | WO 2013/015826 | 1/2013 |
| WO | WO 2013/016097 | 1/2013 |

OTHER PUBLICATIONS

Riza et al., "A Pragmatic Approach to Understanding Liquid Loading in Gas Wells", *SPE Production & Operations*, 2015.

Office Action for Colombian Application No. NC2016/0003228, dated Nov. 8, 2016 with English translation.

Office Action issued in Colombian Patent Application No. NC2016/0003228 dated Nov. 23, 2017 (With English Translation.

Office Action issued in Chinese Application No. 2015/80026265.1, dated May 15, 2018 (English Translation).

Extended European Search Report in 15768393.9, dated Apr. 10, 2017.

Office Action issued in Colombian Patent Application No. NC2016/0003228, dated Feb. 21, 2018 (English Translation).

Office Action issued in Colombian Patent Application No. NC2016/0003228, dated Jan. 4, 2017 (English Translation).

McCoy, "Packer-Type Gas Separator with seating Nipple,", 8$^{th}$ Annual Sucker Rod Pumping Workshop, Renaissance Hotel, Oklahoma City, Oklahoma, Sep. 25-28, 2012 (35 pages).

Office Action issued in EP 15768393.9 dated Jul. 23, 2018 (5 pages).

Office Action issued in Australian Patent Application No. 2015234631 dated Aug. 21, 2018 (7 pages).

Office Action issued in Eurasian Patent Application No. 201691895/31 dated Jul. 18, 2018 ,with English Translation (7 pages).

* cited by examiner

SECTION A - A

BOTTOM VIEW

TOP VIEW

SECTION D - D

ARTIFICIAL LIFT SYSTEM

FIELD

The present disclosure relate to artificial lift system for use in producing hydrocarbon-bearing reservoirs.

BACKGROUND

A sizeable opportunity exists for increasing production and reserves from a horizontal wellbore. To maximize the production and reserves, particularly oil and gas, from a horizontal wellbore and artificial lift system, the system should be designed to be, amongst other things, solids and debris tolerant:

The curved section of a horizontal wellbore is often referred to as the "heal" or "bend" or "build" section of a wellbore where, generally, the wellbore angle/inclination increases from 0 to 90 degrees. Convention sucker rod pumping systems are operationally challenged when the downhole pump component is positioned at an inclination.

All of these challenges result in undesirable higher maintenance frequencies and higher operating costs. To resolve these challenges, most horizontal wells have sucker rod pumps positioned or landed at wellbore inclination angles less than 20 degrees. Landing a pump higher up a wellbore in the minimal inclination section (or in the vertical section) means the pump will not be at the lowermost point or depth in a horizontal well (i.e., the reservoir or horizontal wellbore depth).

For reservoir fluids to inflow into a wellbore, a pressure differential from the reservoir pressure to the pressure inside wellbore must be created. When the pressure in a wellbore is less than the reservoir pressure, reservoir fluids will inflow into the wellbore and this is commonly described as the "draw down". The greater the pressure differential between the reservoir pressure and the wellbore pressure, the greater the rate reservoir fluids will inflow into the wellbore. Equation 1 following describes this differential:

$$\text{Draw Down} = \text{Reservoir Pressure} - \text{Wellbore Pressure}$$

The consequence to the production performance of a well with a pump landed higher up a wellbore is that the differential pressure between the reservoir pressure and the wellbore pressure becomes limited by the depth at which the pump is landed. The wellbore will not able to be drawn down to a minimum pressure, as an accumulation of liquid between the pump suction and the lowermost point in a horizontal wellbore imposes a hydrostatic pressure.

Any amount of vertical fluid level in a wellbore means a well is not fully drawn down. Industry often refers to a wellbore that has no fluid level above the reservoir as being "pumped off". The higher a fluid level is in a wellbore above the reservoir depth, the greater the hydrostatic pressure of that fluid column and therefore less drawdown. The lesser the drawdown, the lower the production rate and reserves recovery. A wellbore not fully drawn down will encounter the minimum economic production rate earlier in time.

At surface, any amount of back pressure imposed to the well will also negatively impact production by reducing the drawdown. Imposing of surface backpressure is caused by surface production handling equipment (separation systems, recovery and handling of natural gas production associated with the oil production, etc.) and frictional pressure losses in a length of pipeline to the nearest battery/facility. At the sucker rod pump depth, gas and liquid are usually separated.

The liquid is pumped to surface by the sucker rod pump and the gas are allowed to naturally migrate up the tubing annulus to surface.

A sucker rod pumping system is not the only means or method for artificially lifting reservoir fluids from a wellbore, but these other systems also face challenges when applied to a horizontal wellbore. The challenges associated with other artificial lift systems for removing reservoir fluids from a horizontal well are as follows:

(i) Electrical Submersible Pump (ESP)—high cost, ESP's have low operating run times when positioned horizontally, ESP's have gas locking problems when positioned horizontally, high maintenance cost to service as requires major workover operation to service (pulling of tubing required);

(ii) Progressive Cavity Pumps (screw pumps)—have elastomer run-life challenges with higher API oil gravities; high maintenance cost to service as requires major workover operation to service (pulling of tubing required);

(iii) Jet and Hydraulic Pumps—high initial cost, high maintenance cost to service as requires major workover operation to service (pulling of tubing required); and (iv) Gas Lifting entire wellbore—high costs associated with an external gas supply requirement, considerable surface equipment requirement, high gas injection pressures, high gas injection rates, and challenges achieving low pressures at lowermost point in a wellbore due to gas expansion friction and inability to place entire well in a mist flow regime condition, high maintenance cost to service as requires major workover operation to service (pulling of tubing required).

SUMMARY

In one aspect, there is provided An artificial lift system disposed within a wellbore, the wellbore including an uphole wellbore zone and a downhole wellbore zone, comprising:

a gas lift apparatus including:

a first tubing;

a second tubing including a density-reduced formation fluid-conducting fluid passage, wherein the second tubing is disposed within the first tubing;

a gaseous material-conducting fluid passage for conducting gaseous material, including a downhole gaseous material-conducting fluid passage defined by an annulus disposed between the first tubing and the second tubing;

a downhole gaseous material-conducting fluid passage outlet, fluidly coupled to the downhole gaseous material-conducting fluid passage, for discharging the conducted gaseous material to effect contacting between the discharged gaseous material and formation fluid disposed within the downhole wellbore zone to effect production of a density-reduced formation fluid;

wherein the density-reduced formation fluid-conducting fluid passage is disposed for conducting the density-reduced formation fluid, in response to at least reservoir pressure and inducement by a pump, and includes an inlet disposed in sufficient proximity to the outlet of the downhole gaseous material-conducting fluid passage such that the density-reduced formation fluid-conducting fluid passage inlet is disposed for receiving the produced density-reduced formation fluid;

a density-reduced formation fluid-discharging outlet, disposed in fluid communication with the density-reduced formation fluid-conducting fluid passage for receiving and discharging the density-reduced formation fluid, conducted by the density-reduced formation fluid-conducting fluid passage, into the uphole wellbore zone;

wherein the uphole wellbore zone includes a gas separation zone within which separation of separated gaseous material from the discharged density-reduced formation fluid, in response to buoyancy forces, is effected such that a gaseous material-depleted formation fluid is produced;

and a fluidic isolation device disposed between the uphole wellbore zone and the downhole wellbore zone, for preventing, or substantially preventing, flow of the gaseous material-depleted formation fluid from the uphole wellbore zone to the downhole wellbore zone;

and a downhole pumping apparatus including:

a pump, disposed for inducing flow of formation fluid through the density-reduced formation fluid-conducting fluid passage, the pump including a suction for receiving the gaseous material-depleted formation fluid from the uphole wellbore zone, and a discharge for discharging pressurized gaseous material-depleted formation fluid; and a production conduit disposed in fluid communication with the discharge and extending uphole, relative to the pump, to a wellhead, for flowing the pressurized gaseous material-depleted formation fluid to the wellhead.

In another aspect, there is provided a gas lift apparatus positionable within a wellbore, the wellbore including an uphole wellbore zone and a downhole wellbore zone, comprising:

a first tubing;

a second tubing including a density-reduced formation fluid-conducting fluid passage, wherein the second tubing is disposed within the first tubing;

a gaseous material-conducting fluid passage for conducting gaseous material, including a downhole gaseous material-conducting fluid passage defined by an annulus disposed between the first tubing and the second tubing;

a downhole gaseous material-conducting fluid passage outlet, fluidly coupled to the downhole gaseous material-conducting fluid passage, for discharging the conducted gaseous material to effect contacting between the discharged gaseous material and formation fluid disposed within the downhole wellbore zone to effect production of a density-reduced formation fluid;

wherein the density-reduced formation fluid-conducting fluid passage is disposed for conducting the produced density-reduced formation fluid, in response to at least reservoir pressure, and includes an inlet disposed in sufficient proximity to the outlet of the downhole gaseous material-conducting fluid passage such that the density-reduced formation fluid-conducting fluid passage inlet is disposed for receiving the density-reduced formation fluid;

a density-reduced formation fluid-discharging outlet, disposed in fluid communication with the density-reduced formation fluid-conducting fluid passage for receiving and discharging the density-reduced formation fluid, conducted by the density-reduced formation fluid-conducting fluid passage, into the uphole wellbore zone; and a fluidic isolation device for preventing, or substantially preventing, flow of gaseous material-depleted formation fluid, that is separated from the density-reduced formation fluid, from the uphole wellbore zone to the downhole wellbore zone.

In a further aspect, there is provided an artificial lift system disposed within a wellbore, the wellbore including an uphole wellbore zone and a downhole wellbore zone, comprising:

a formation fluid-conducting apparatus including:

a formation fluid-conducting fluid passage for conducting formation fluid from the downhole wellbore zone;

a formation fluid-discharging outlet for discharging the conducted formation fluid into the uphole wellbore zone;

wherein the uphole wellbore zone includes a gas separation zone within which separation of gaseous material from the discharged density-reduced formation fluid, in response to buoyancy forces, is effected such that a gaseous material-depleted formation fluid is produced;

and a fluidic isolation device disposed between the uphole wellbore zone and the downhole wellbore zone, for preventing, or substantially preventing, flow of gaseous material-depleted formation fluid from the uphole wellbore zone to the downhole wellbore zone;

and a downhole pumping apparatus including:

a pump, disposed for inducing flow of formation fluid through the formation fluid-conducting apparatus, the pump including a suction for receiving the gaseous material-depleted formation fluid, and a discharge for discharging pressurized gaseous material-depleted formation fluid; and a production fluid passage disposed in fluid communication with the discharge and extending uphole, relative to the pump, to a wellhead, for flowing the pressurized gaseous material-depleted formation fluid to the wellhead;

wherein the formation fluid-conducting passage outlet is oriented uphole such that its axis is disposed at an angle of less than 60 degrees relative to the vertical.

In yet another aspect, there is provided an artificial lift system disposed within a wellbore, the wellbore including an uphole wellbore zone and a downhole wellbore zone, comprising:

a formation fluid-conducting apparatus including:

a formation fluid-conducting fluid passage for conducting formation fluid from the downhole wellbore zone;

a formation fluid-discharging outlet for discharging the conducted formation fluid into the uphole wellbore zone;

wherein the uphole wellbore zone includes a gas separation zone within which separation of gaseous material from the discharged density-reduced formation fluid, in response to buoyancy forces, is effected such that a gaseous material-depleted formation fluid is produced;

and a fluidic isolation device disposed between the uphole wellbore zone and the downhole wellbore zone, for preventing, or substantially preventing, flow of the gaseous material-depleted formation fluid from the uphole wellbore zone to the downhole wellbore zone;

a downhole pumping apparatus including:

a pump, disposed for inducing flow of formation fluid through the formation fluid-conducting apparatus, the pump including a suction for receiving the gaseous material-depleted formation fluid from the uphole wellbore zone, and a discharge for discharging pressurized gaseous material-depleted formation fluid; and a production fluid passage disposed in fluid communication with the discharge and extending uphole, relative to the pump, to a wellhead, for flowing the pressurized gaseous material-depleted formation fluid to the wellhead;

and a connector connecting the formation fluid-conducting apparatus to the downhole pumping apparatus.

In another aspect, there is provided an artificial lift apparatus configured for disposition within a wellbore, the wellbore including an uphole wellbore zone and a downhole wellbore zone, comprising:

a formation fluid-conducting apparatus including:

a formation fluid-conducting fluid passage for conducting formation fluid from the downhole wellbore zone;

a formation fluid-discharging outlet for discharging the conducted formation fluid into the uphole wellbore zone, and a fluidic isolation device for disposition between the uphole wellbore zone and the downhole wellbore zone, for preventing flow of gaseous material-depleted formation fluid, that has separated from the discharged conducted formation fluid within the uphole wellbore zone, from the uphole wellbore zone to the downhole wellbore zone;

a downhole pumping apparatus including:

a pump disposed for inducing flow of formation fluid through the formation fluid-conducting apparatus, the pump including a suction for receiving the gaseous material-depleted formation fluid from the uphole wellbore zone, and a discharge for discharging pressurized gaseous material-depleted formation fluid; and a production fluid passage disposed in fluid communication with the discharge and configured for extending uphole, relative to the pump, to a wellhead, for flowing the pressurized gaseous material-depleted formation fluid to the wellhead;

and a connector connecting the formation fluid conducting apparatus to the downhole pumping apparatus.

In a further aspect, there is provided An artificial lift apparatus configured for disposition within a wellbore, the wellbore including an uphole wellbore zone and a downhole wellbore zone, comprising:

a formation fluid conducting system including:

a conduit that includes a conduit-defined formation fluid-conducting fluid passage for conducting formation fluid from the downhole wellbore zone;

a fluidic isolation device for disposition between the uphole wellbore zone and the downhole wellbore zone, for preventing, or substantially preventing, flow of gaseous material-depleted formation fluid, that has separated from the discharged conducted formation fluid within the uphole wellbore zone, from the uphole wellbore zone to the downhole wellbore zone;

a pumping system including:

a pump disposed for inducing flow of formation fluid through the formation fluid-conducting apparatus, the pump including a suction for receiving the gaseous material-depleted formation fluid from the uphole wellbore zone, and a discharge for discharging pressurized gaseous material-depleted formation fluid; and a production fluid passage disposed in fluid communication with the discharge and configured for extending uphole, relative to the pump, to a wellhead, for flowing the pressurized gaseous material-depleted formation fluid to the wellhead;

and a fluid flow connector connecting the formation fluid conducting system to the pumping system, the connector including:

a connector-defined formation fluid-conducting fluid passage for receiving formation fluid being conducted by the conduit-defined formation fluid-conducting fluid passage and conducting the received formation fluid to a formation fluid-discharging outlet for discharging the conducted formation fluid into the uphole wellbore zone; and a connector-defined gaseous material-depleted formation fluid-conducting fluid passage for receiving gaseous material-depleted formation fluid from the uphole wellbore zone, and conducting the received gaseous material-depleted formation fluid to the pump suction.

In another aspect, there is provided A fluid flow connector comprising:

a formation fluid inlet, defined by a formation fluid inlet port, for receiving formation fluid;

a formation fluid outlet, defined by a plurality of formation fluid outlet ports, for discharging the received formation fluid;

a connector-defined formation fluid-conducting fluid passage, for effecting fluid coupling of the formation fluid inlet port to the formation fluid outlet ports;

a gaseous material-depleted formation fluid inlet, defined by a plurality of gaseous material-depleted formation fluid inlet ports, for receiving gaseous material-depleted formation fluid;

a gaseous material-depleted formation fluid outlet, defined by a gaseous material-depleted formation fluid outlet port, for discharging the received gaseous material-depleted formation fluid;

a connector-defined gaseous material-depleted formation fluid-conducting fluid passage, for effecting fluid coupling between the plurality of gaseous material-depleted formation fluid inlet ports and the gaseous material-depleted formation fluid outlet port;

a first side surface; and a second side surface, disposed at an opposite side of the connector relative to the first side surface;

wherein the gaseous material-depleted formation fluid inlet ports and the formation fluid inlet port are disposed on the first side surface, and each one of the gaseous material-depleted formation fluid inlet ports is offset relative to the formation fluid inlet port;

and wherein the formation fluid outlet ports and the gaseous material-depleted formation fluid outlet port are disposed on the second side surface, and each one of the formation fluid outlet ports is offset relative to the gaseous material-depleted formation fluid outlet port;

and wherein the axis of the formation fluid inlet port and the axis of the gaseous material-depleted formation fluid outlet port are disposed in alignment or substantial alignment.

BRIEF DESCRIPTION OF DRAWINGS

The process of the preferred embodiments of the invention will now be described with the following accompanying drawing.

DETAILED DESCRIPTION

Figure 1:
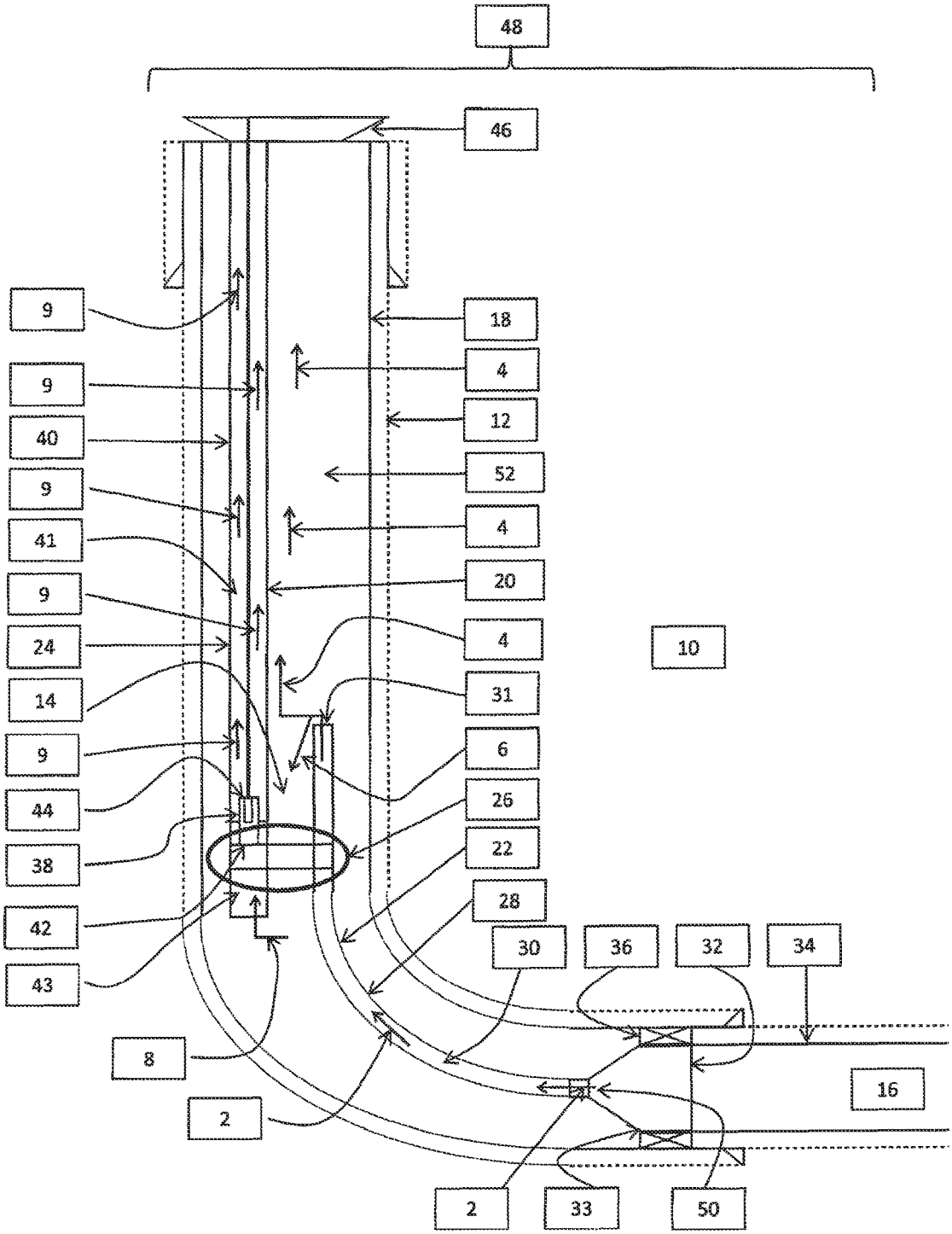
FIG. 1 is a schematic illustration of an embodiment of an artificial lift system of the present disclosure using a downhole pump.

As used herein, the terms "up", "upward", "upper", or "uphole", mean, relativistically, in closer proximity to the surface and further away from the bottom of the wellbore, when measured along the longitudinal axis of the wellbore. The terms "down", "downward", "lower", or "downhole" mean, relativistically, further away from the surface and in closer proximity to the bottom of the wellbore, when measured along the longitudinal axis of the wellbore.

There is provided apparati and systems for producing hydrocarbons from a subterranean formation 10, when reservoir pressure within the subterranean formation is insufficient to conduct hydrocarbons to the surface through a wellbore 12.

The wellbore 12 can be straight, curved, or branched. The wellbore can have various wellbore portions. A wellbore portion is an axial length of a wellbore. A wellbore portion can be characterized as "vertical" or "horizontal" even though the actual axial orientation can vary from true vertical or true horizontal, and even though the axial path can tend to "corkscrew" or otherwise vary. The term "horizontal", when used to describe a wellbore portion, refers to a horizontal or highly deviated wellbore portion as understood in the art, such as, for example, a wellbore portion having a longitudinal axis that is between 70 and 110 degrees from vertical.

The wellbore 12 may be completed either as a cased-hole completion or an open-hole completion.

Well completion is the process of preparing the well for injection of fluids into the subterranean formation, or for production of formation fluids from the subterranean formation. This may involve the provision of a variety of components and systems to facilitate the injection and/or production of fluids, including components or systems to segregate subterranean formation zones along sections of the wellbore. "Formation fluid" is fluid that is contained within a subterranean formation. Formation fluid may be liquid material, gaseous material, or a mixture of liquid material and gaseous material. In some embodiments, for example, the formation fluid includes water and hydrocarbons, such as oil, natural gas, or combinations thereof.

Fluids may be injected into the subterranean formation through the wellbore to effect stimulation of the formation fluids. For example, such fluid injection is effected during hydraulic fracturing, water flooding, water disposal, gas floods, gas disposal (including carbon dioxide sequestration), steam-assisted gravity drainage ("SAGD") or cyclic steam stimulation ("CSS"). In some embodiments, for example, the same wellbore is utilized for both stimulation and production operations, such as for hydraulically fractured formations or for formations subjected to CSS. In some embodiments, for example, different wellbores are used, such as for formations subjected to SAGD, or formations subjected to waterflooding.

A cased-hole completion involves running casing down into the wellbore through the production zone. The casing at least contributes to the stabilization of the subterranean formation after the wellbore has been completed, by at least contributing to the prevention of the collapse of the subterranean formation within which the wellbore is defined.

The annular region between the deployed casing and the subterranean formation may be filled with cement for effecting zonal isolation (see below). The cement is disposed between the casing and the subterranean formation for the purpose of effecting isolation, or substantial isolation, of one or more zones of the subterranean formation from fluids disposed in another zone of the subterranean formation. Such fluids include formation fluid being produced from another zone of the subterranean formation (in some embodiments, for example, such formation fluid being flowed through a production tubing string disposed within and extending through the casing to the surface), or injected fluids such as water, gas (including carbon dioxide), or stimulations fluids such as fracturing fluid or acid. In this respect, in some embodiments, for example, the cement is provided for effecting sealing, or substantial sealing, of fluid communication between one or more zones of the subterranean formation and one or more others zones of the subterranean formation (for example, such as a zone that is being produced). By effecting the sealing, or substantial sealing, of such fluid communication, isolation, or substantial isolation, of one or more zones of the subterranean formation, from another subterranean zone (such as a producing formation), is achieved. Such isolation or substantial isolation is desirable, for example, for mitigating contamination of a water table within the subterranean formation by the formation fluids (e.g. oil, gas, salt water, or combinations thereof) being produced, or the above-described injected fluids. Fluid communication between the wellbore and the formation is effected by perforating the production casing.

In some embodiments, for example, the cement is disposed as a sheath within an annular region between the production casing and the subterranean formation. In some embodiments, for example, the cement is bonded to both of the production casing and the subterranean formation.

In some embodiments, for example, the cement also provides one or more of the following functions: (a) strengthens and reinforces the structural integrity of the wellbore, (b) prevents, or substantially prevents, produced formation fluids of one zone from being diluted by water from other zones. (c) mitigates corrosion of the casing, and (d) at least contributes to the support of the casing.

The cement is introduced to an annular region between the casing and the subterranean formation after the subject casing has been run into the wellbore. This operation is known as "cementing".

In some embodiments, for example, the casing includes one or more casing strings, each of which is positioned within the well bore, having one end extending from the well head. In some embodiments, for example, each casing string is defined by jointed segments of pipe. The jointed segments of pipe typically have threaded connections.

Typically, a wellbore contains multiple intervals of concentric casing strings, successively deployed within the previously run casing. With the exception of a liner string, casing strings typically run back up to the surface.

For wells that are used for producing formation fluids, few of these actually produce through casing. This is because producing fluids can corrode steel or form undesirable deposits (for example, scales, asphaltenes or paraffin waxes) and the larger diameter can make flow unstable. In this respect, a production tubing string is usually installed inside the last casing string. The production tubing string is provided to conduct produced formation fluids to the wellhead. In some embodiments, for example. the annular region between the last casing string and the production tubing string may be sealed at the bottom by a packer.

In some embodiments, for example and referring to FIG. 1, the casing 18 is set short of total depth. Hanging off from the bottom of the casing 18, with a liner hanger or packer 36, is a liner string 34. The liner string can be made from the same material as the casing string, but, unlike the casing string, the liner string does not extend back to the wellhead. Cement may be provided within the annular region between the liner string and the subterranean formation for effecting zonal isolation (see below), but is not in all cases. In some embodiments, for example, this liner is perforated to access the reservoir. In this respect, in some embodiments, for example, the liner string can also be a screen or is slotted. In some embodiments, for example, the production tubing string may be stung into the liner string, thereby providing a fluid passage for conducting the produced formation fluids to the wellhead. In some embodiments, for example, no cemented liner is installed, and this is called an open hole completion.

An open-hole completion is effected by drilling down to the top of the producing formation, and then casing the wellbore. The wellbore is then drilled through the producing formation, and the bottom of the wellbore is left open (i.e. uncased). Open-hole completion techniques include bare foot completions, pre-drilled and pre-slotted liners, and open-hole sand control techniques such as stand-alone screens, open hole gravel packs and open hole expandable screens. Packers can segment the open hole into separate intervals.

1. Artificial Lift Apparatus and System with Downhole Pumping Apparatus

In one aspect, and referring to FIG. 1, there is provided an artificial lift apparatus 20 configured for disposition within a wellbore 12, with the wellbore including an uphole wellbore zone 14 and a downhole wellbore zone 16. The uphole and downhole wellbore zones 14, 16 are disposed within the casing 18. The artificial lift apparatus 20 includes a formation fluid-conducting apparatus 22 and a downhole pumping apparatus 24. The formation fluid-conducting apparatus 22 is configured for delivering formation fluid to the downhole pumping apparatus 24. In some embodiments, there is also provided a connector 26, and the connector connects the formation fluid-conducting apparatus 22 to the downhole pumping apparatus 24.

The formation fluid-conducting apparatus 22 includes a formation fluid-conducting fluid passage 30 for conducting formation fluid from the downhole wellbore zone 16. The apparatus further includes an outlet 31 for discharging the conducted formation fluid into the uphole wellbore zone 14. In some embodiments, for example, the fluid passage 30 and the outlet 31 are defined within a conduit 28

The formation fluid-conducting apparatus 22 further includes a fluidic isolation device 32 for disposition between the uphole wellbore zone 14 and the downhole wellbore zone 16. The fluidic isolation device 32 is configured to prevent, or substantially prevent, flow of the gaseous material-depleted formation fluid (that is separated from the formation fluid discharged from the outlet 31—see below) from the uphole wellbore zone to the downhole wellbore zone.

In some embodiments, for example, the fluidic isolation device 32 includes a packer 36, and the packer is disposable for sealing engagement or substantially sealing engagement with the casing, when the apparatus is disposed within the wellbore.

In some embodiments, for example, and, in particular, the embodiment illustrated in FIG. 1, the fluidic isolation device 32 includes a sealing member, and the sealing member is disposable for sealing engagement with a liner string 34, when the apparatus 20 is disposed or "stung" into a liner string 34 within the wellbore 12.

In some embodiments, for example, the fluidic isolation device 32 includes a sealing member, and the sealing member is disposable for sealing engagement or substantially sealing engagement with the casing, such as a constricted portion of the casing, when the apparatus is disposed within the wellbore.

The downhole pumping apparatus 24 includes a pump 38 and a production fluid passage 41. In some embodiments for example, the production fluid passage 41 is defined by the production string 40 (or production conduit). The pump 38 is disposed for inducing flow of formation fluid through the formation fluid-conducting apparatus 22. The pump includes a suction 42 and a discharge 44. The downhole pumping apparatus 24 includes a gaseous material-depleted formation fluid-conducting fluid passage 43 for receiving the gaseous material-depleted formation fluid from the uphole wellbore zone 14 (see below) and conducting such received gaseous material-depleted formation fluid to the pump suction 42. The discharge 44 is provided for discharging pressurized gaseous material-depleted formation fluid.

The production fluid passage 41 is disposed in fluid communication with the discharge 44 of the pump 38 and is configured for extending uphole, relative to the pump 38, to a wellhead 46, for flowing the pressurized gaseous material-depleted formation fluid to the wellhead 46, when the apparatus 20 is disposed within the wellbore 12.

As mentioned above, the connector 26 connects the formation fluid-conducting apparatus 22 to the downhole pumping apparatus 24. In some embodiments, for example, the formation fluid-conducting fluid passage outlet 31 is configured to be oriented uphole, when disposed within the wellbore, such that its axis is disposed at an angle of less than 60 degrees relative to the vertical. In some embodiments, for example, the outlet 31 is configured to be oriented uphole, when disposed within the wellbore, such that its axis is disposed at an angle of less than 45 degrees relative to the vertical. In some embodiments, for example, the axis of the outlet 31 is configured for disposition out of alignment with the pump 38.

Figure 2:
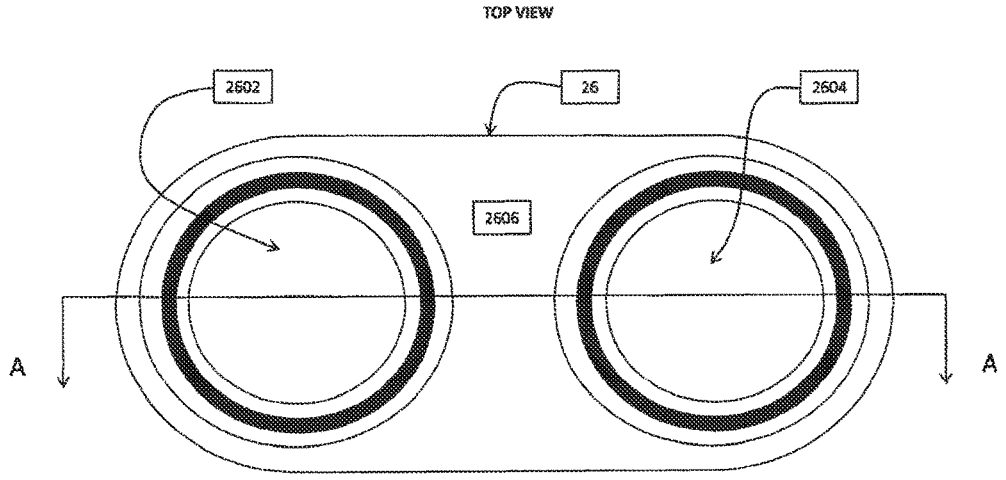
FIG. 2 is a top plan view of an embodiment of a connector of the artificial lift apparatus of the lift system illustrated in FIG. 1.
Figure 3:
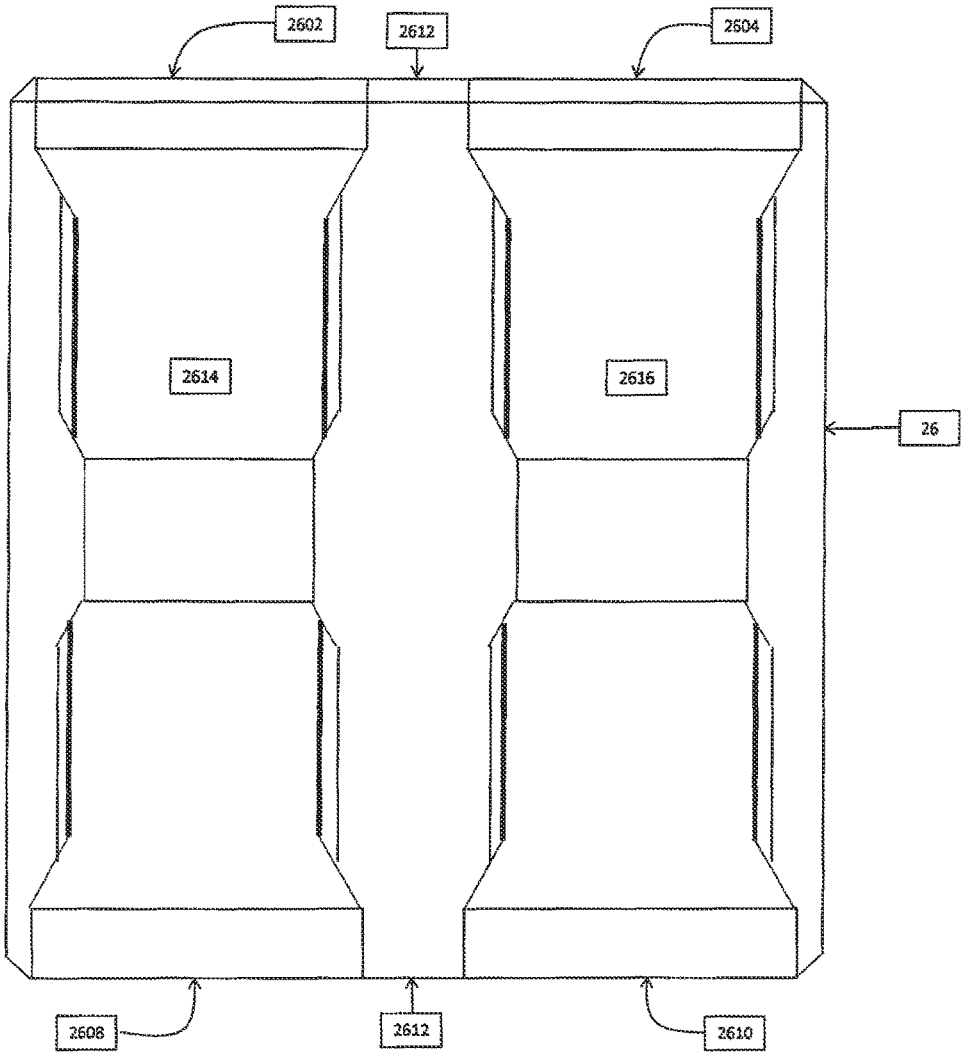
FIG. 3 is sectional elevation view, taken along lines A-A of FIG. 2, of the connector illustrated in FIG. 2.
Figure 4:
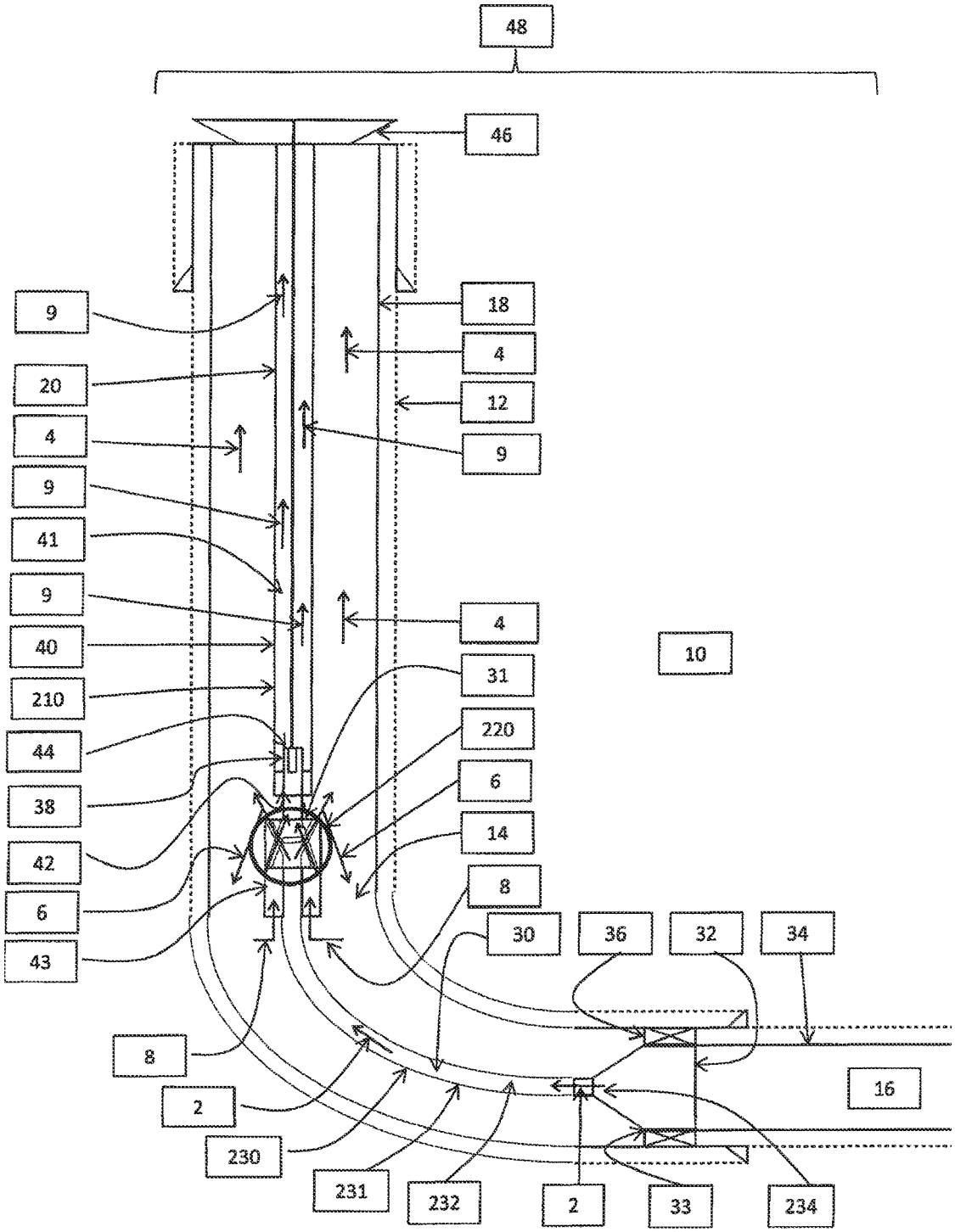
FIG. 4 is a schematic illustration of another artificial lift system of the present disclosure using a downhole pump.

Referring to FIGS. 2 and 3, the connector 26 includes ports 2602, 2604 disposed at a first side surface 2606, and ports 2608, 2610 disposed at a second side surface 2612. Passage 2614 fluidly couples the port 2602 to the port 2608. Passage 2616 fluidly couples the port 2604 to the port 2610. The port 2602 is connected to the pump suction 42, and facilitates receiving of the gaseous-depleted formation fluid by the pump suction via the fluid passage 2614. The port 2610 is connected to the conduit 28 such that formation fluid is conducted through the passage 2616 and discharged from the port 2604.

In some embodiments, and referring to FIGS. 4 to 8, the artificial lift apparatus 20 includes a formation fluid conducting system 230, a fluid flow connector 220, and a pumping system 210.

The formation fluid conducting system 230 includes a conduit 231 that includes a conduit-defined formation fluid-conducting fluid passage 232 for conducting formation fluid from the downhole wellbore zone 16 to the fluid flow connector 220. The conduit 231 includes an inlet 234 for receiving formation fluid from the downhole wellbore zone 16.

The formation fluid-conducting system 230 further includes the fluidic isolation device 32 for disposition between the uphole wellbore zone 14 and the downhole wellbore zone 16. As described above, the fluidic isolation device 32 is configured to prevent, or substantially prevent, flow of the gaseous material-depleted formation fluid (that is separated from the discharged density-reduced formation fluid) from the uphole wellbore zone to the downhole wellbore zone.

The pumping system 210 includes the pump 38 and a production fluid passage 41. In some embodiments for example, the production fluid passage 41 is defined by the production string 40 (or production conduit). The pump 38 is disposed for inducing flow of formation fluid through the formation fluid-conducting apparatus 230. The pump 38 includes the suction 42 and the discharge 44. The suction 42 is configured for receiving formation fluid from the formation fluid-conducting apparatus 230. The discharge 44 is provided for discharging pressurized gaseous material-depleted formation fluid.

The fluid flow connector 220 connects the formation fluid conducting system 230 to the pumping system 210. In this respect, the connector 220 includes a connector-defined formation fluid-conducting fluid passage 222 and a connector-defined gaseous material-depleted formation fluid-conducting fluid passage 224.

Figure 5:
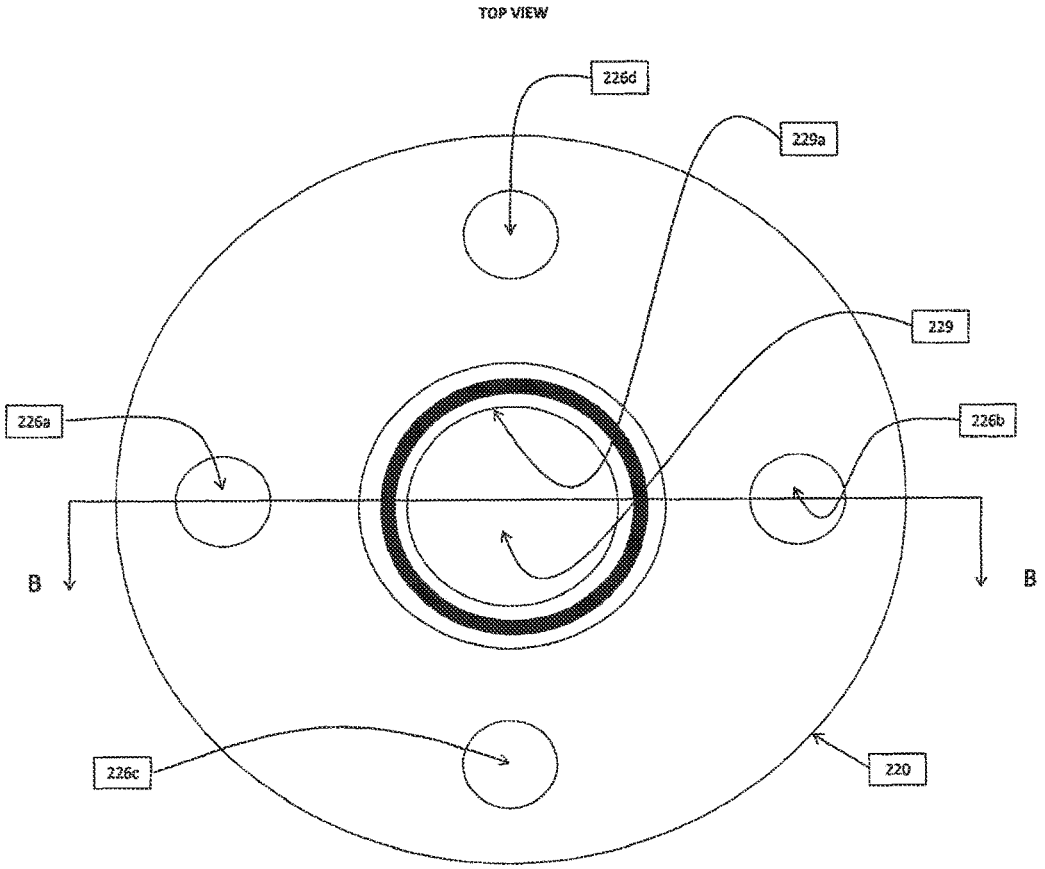
FIG. 5 is a top plan view of an embodiment of a connector of the artificial lift apparatus of the lift system illustrated in FIG. 4.
Figure 7:
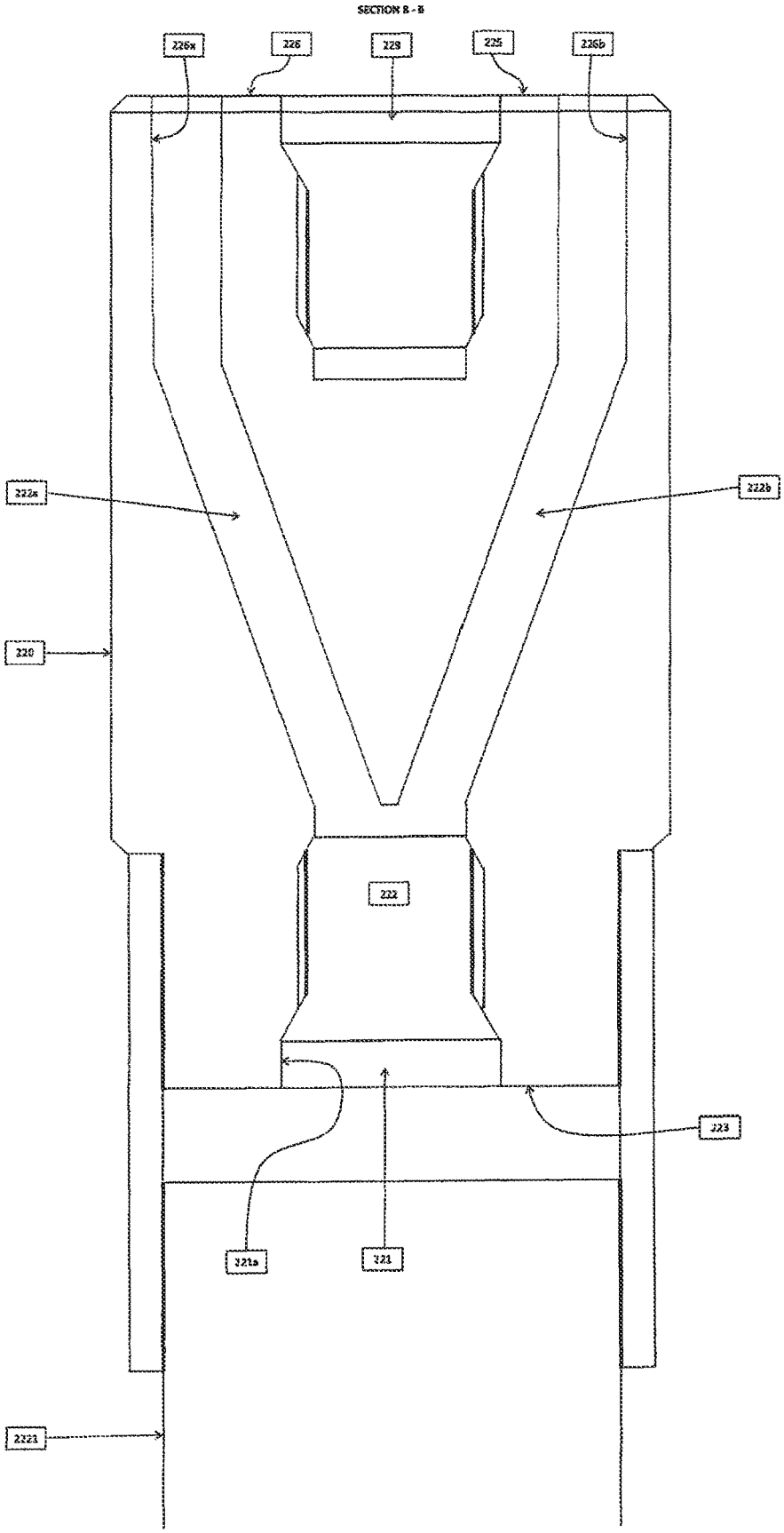
FIG. 7 is a sectional elevation view, taken along lines B-B in FIG. 5, of the connector illustrated in FIG. 5.

Referring to FIGS. 5 and 7, the connector 220 further includes an inlet 221, defined by an inlet port 221*a*, for receiving formation fluid being conducted by the conduit-defined formation fluid-conducting fluid passage 232, and an outlet 226 for discharging the conducted formation fluid (conducted by the fluid passage 222 through the connector 220) into the uphole wellbore zone 14. In some embodiments, for example, the outlet 226 is equivalent to the outlet 31. In some embodiments, for example, the outlet 226 includes a plurality of outlet ports 226*a*, 226*b*, 226*c*, 226*d* (two are shown), and the fluid passage 222 includes branched fluid passage portions 222*a*, 222*b*, 222*c*, 222*d* that extend into corresponding outlet ports 226*a*, 226*b*, 226*c*, 226*d*. The fluid passage 222 effects fluid coupling between the inlet port 221*a* and the outlet ports 226*a*, 226*b*, 226*c*, 226*d*. In some embodiments, for example, the formation fluid-conducting fluid passage 30 includes the combination of the fluid passage 232 and the fluid passage 222.

In some embodiments, each one of the outlet ports 226*a*, 226*b*, 226*c*, 226*d* is oriented uphole, such that its axis is disposed at an angle of less than 60 degrees relative to the axis of the inlet 221. In some embodiments, for example, the axis is disposed at an angle of less than 45 degrees relative to the axis of the inlet 221. In some embodiments, for example, the axis of the inlet 221 is configured for vertical disposition when the connector is connecting the formation fluid conducting system 230 to the pumping system 210, and the apparatus 20 is disposed within a wellbore. In some embodiments, for example, the axis of each one of the outlet ports 226*a*, 226*b*, 226*c*, 226*d* is disposed out of alignment with the pump 38. This facilitates improved separation of the gaseous formation fluid material from the discharged density-reduced formation fluid.

Figure 6:
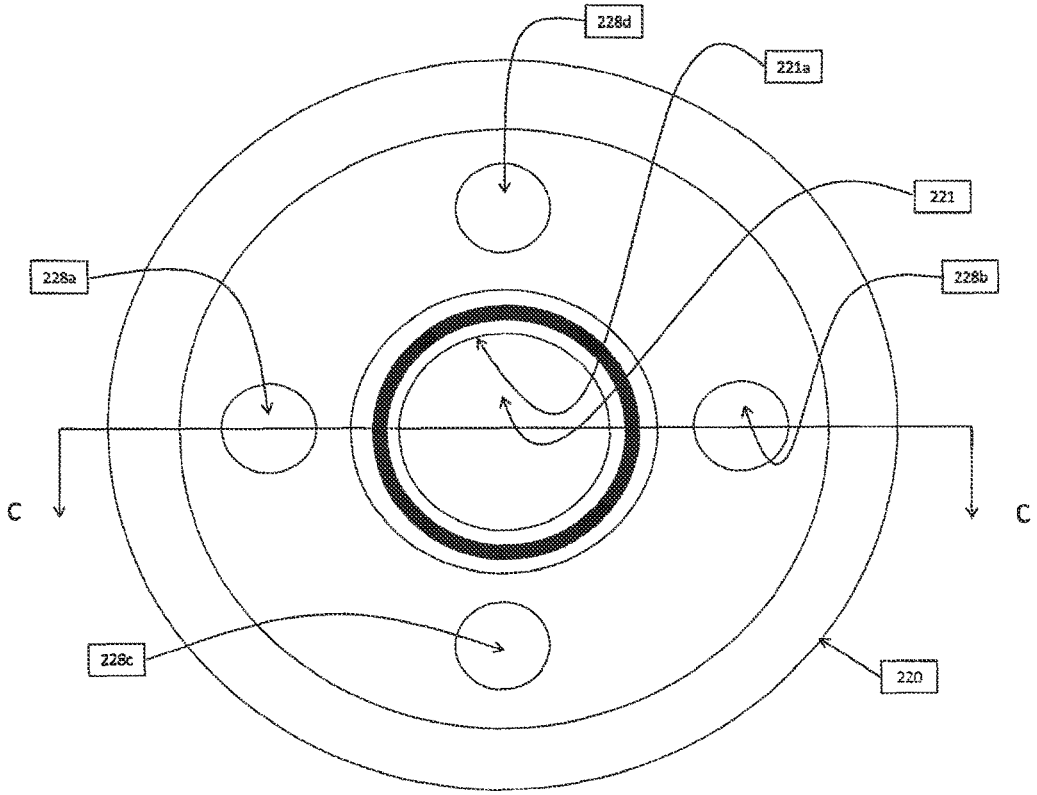
FIG. 6 is a bottom plan view of the connector illustrated in FIG. 5.
Figure 8:
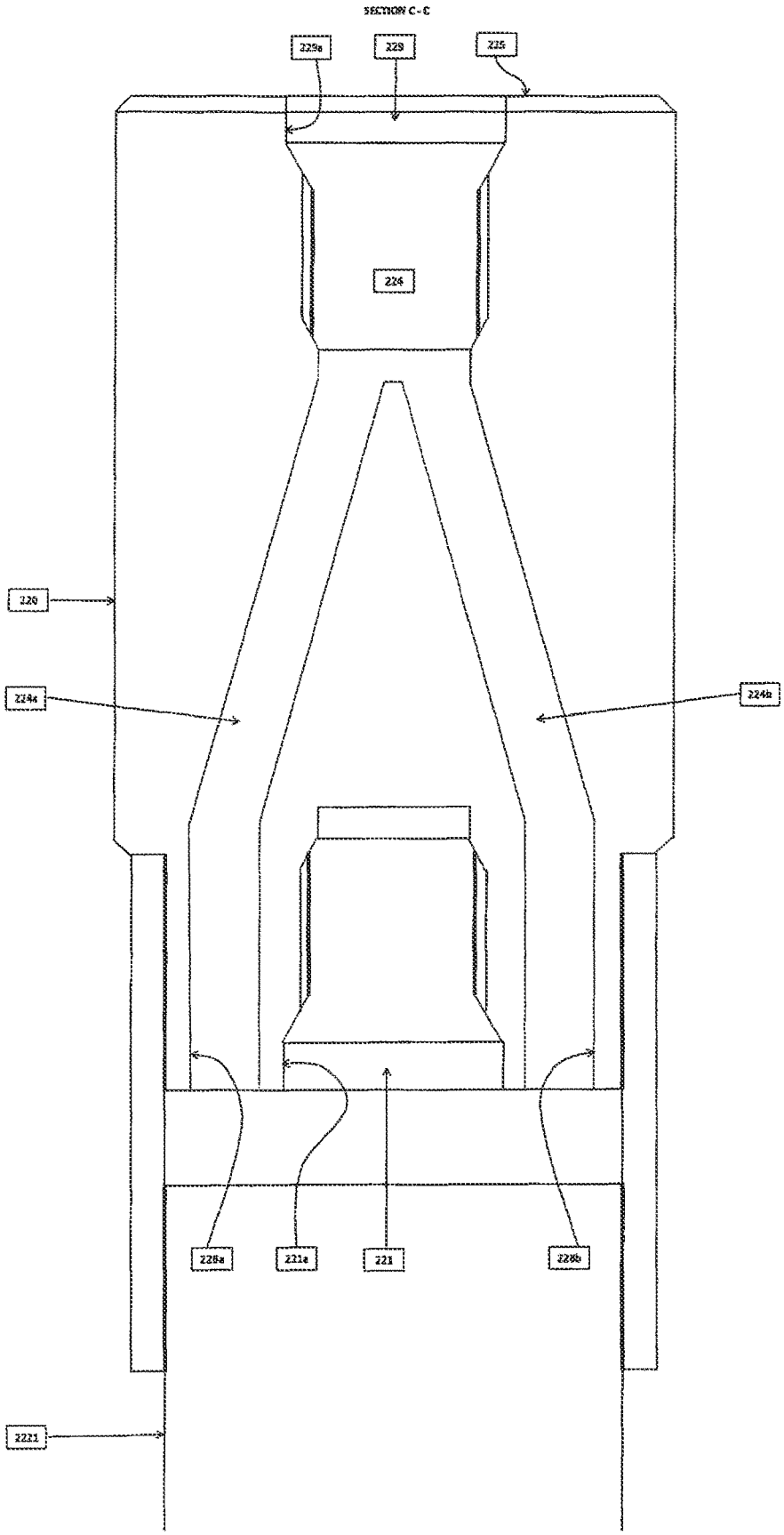
FIG. 8 is a sectional elevation view, taken along lines C-C in FIG. 6, of the connector illustrated in FIG. 5.

Referring to FIGS. 6 and 8, the connector 220 further includes an inlet 228 for receiving the gaseous material-depleted formation fluid from the uphole wellbore zone 14 (see below). In some embodiments, for example, the inlet 228 includes a plurality of inlet ports 228*a*, 228*b*, 228*c*, 228*d*. The inlet 228 is configured for disposition below the outlet 226. The connector further includes an outlet 229, defined by an outlet port 229*a*. The port 229*a* is configured for connection to the pump suction 42. The connector-defined gaseous material-depleted formation fluid-conducting fluid passage 224 effects fluid coupling between the inlet ports 228*a*, 228*b*, 228*c*, 228*d* and the outlet port 229*a* for conducting the received gaseous material-depleted formation fluid from the inlet 228 to the pump suction 42 for energizing by the pump 38. In this respect, the connector-defined gaseous material-depleted formation fluid-conducting fluid passage 224 effect fluid coupling between the pump suction 42 and the inlet 228 when the port 229*a* is connected to the pump suction 42. In some embodiments, for example, and the fluid passage 224 includes branched fluid passage portions 224*a*, 224*b*, 224*c*, 224*d* (two are shown) that extend from corresponding inlet ports 228*a*, 228*b*, 228*c*, 228*d*. In some embodiments, for example, the gaseous material-depleted formation fluid-conducting fluid passage 43 includes the connector-defined gaseous material-depleted formation fluid-conducting fluid passage 224.

In some embodiments, for example, each one of the inlet ports 228*a*, 228*b*, 228*c*, 228*d* is disposed on the same side surface 223 of the connector 220 as the inlet port 221*a*, and is offset relative to the inlet port 221*a*, and each one of the outlet ports 226*a*, 226*b*, 226*c*, 226*d* is disposed on the same side surface 225 of the connector 220 as the outlet port 229*a* and is offset relative to the outlet port 229*a*, and the side surface 223 is disposed on an opposite side of the connector 220 relative to the side surface 225. In some of these embodiments, for example, the axis of the inlet port 221*a* and the axis of the outlet port 229*a* are disposed in alignment or substantial alignment. In some of these embodiments, for example, the connector-defined formation fluid-conducting fluid passage 222 and the connector-defined gaseous material-depleted formation fluid-conducting fluid passage 224 do not intersect.

In some embodiments, for example, the connector 220 further includes a shroud 2221 extending downwardly below the inlet ports 228*a*, 228*b*, 228*c*, 228*d*. This provides increased residence time for separation of the formation fluids, discharged from the outlet 31, into the gaseous formation fluid material and the gaseous material-depleted formation fluid (see below).

The artificial lift apparatus 20 may be deployed within a wellbore 12 to provide a system 48, as illustrated in FIG. 1. In this respect, a system 48 is provided including the artificial lift apparatus 20, described above, disposed within the wellbore 12.

The formation fluid-conducting fluid passage 30 of the formation fluid-conducting apparatus 22 includes an inlet 50 (such as inlet 234) disposed for receiving formation fluid from the downhole wellbore zone 16. The artificial lift apparatus 20 is co-operatively disposed relative to the wellbore 18 such that the pump 38 is disposed for inducing flow of the formation fluid to the formation fluid-conducting fluid passage 30. The flowing is also effected, at least in part, in response to reservoir pressure within the subterranean formation 10, as well as inducement by the suction 42 of the pump 38. The formation fluid-conducting fluid passage 30 is configured for conducting the received formation fluid to the formation fluid-conducting fluid passage outlet 31.

The formation fluid-conducting fluid passage outlet 31 is disposed for discharging the conducted formation fluid into the uphole wellbore zone 14. The uphole wellbore zone 14 includes a gas separation zone within which separation of gaseous formation fluid material from the discharged formation fluid, in response to buoyancy forces, is effected such that a gaseous material-depleted formation fluid is produced. In some embodiments, for example, the gas separation zone is disposed within an annulus 52 defined between the casing and the downhole pumping apparatus. In this respect, within the gas separation zone, the discharged density-reduced formation fluid is separated into the gaseous formation fluid material and the gaseous material-depleted formation fluid. The gaseous formation fluid material is conducted uphole to the wellhead 46, through the annulus 52 disposed between the downhole pumping apparatus 24 and the casing 18, and is then discharged from the wellbore 12 through the wellhead 46. The gaseous formation fluid material may be discharged from the wellhead 46 and conducted to a collection facility 400, such as storage tanks within a battery.

In some embodiments, for example, the formation fluid-conducting fluid passage outlet 31, of the formation fluid-conducting apparatus, is oriented uphole, such that its axis is disposed at an angle of less than 60 degrees relative to the vertical. In some embodiments, for example, the axis of the outlet 31 is disposed at an angle of less than 45 degrees relative to the vertical. In some embodiments, for example, the axis of the outlet 31 is disposed out of alignment with the pump 38. This facilitates improved separation of the gaseous formation fluid material from the discharged density-reduced formation fluid.

The fluidic isolation device 32 is disposed between the uphole wellbore zone 14 and the downhole wellbore zone 16 for preventing flow of the gaseous material-depleted formation fluid (that is separated from the discharged density-reduced formation fluid) from the uphole wellbore zone 14 to the downhole wellbore zone 16.

In some embodiments, for example, the fluidic isolation device 32 includes a packer 36, and the packer is disposed in sealing engagement with the casing.

In some embodiments, for example, and particularly illustrated in FIG. 1, the fluidic isolation device 32 includes a sealing member 33, and the formation fluid-conducting apparatus is disposed or "stung" into the liner string 34, such that the sealing member 33 is disposed within and in sealing engagement, or substantially sealing engagement, with a liner string 34.

In some embodiments, for example, the fluidic isolation device 32 includes a sealing member, and the sealing member is disposed in sealing engagement, or substantially sealing engagement, with the casing, such as a constricted portion of the casing.

The pump 38 is disposed for receiving the separated gaseous material-depleted formation fluid through the suction 42 and energizing the received gaseous material-depleted formation fluid. The energized formation fluid is discharged from the pump 38 through the discharge 44 and into the production fluid passage 41. The production fluid passage 41 is disposed to deliver the energized formation fluid to the surface through the wellhead 46. The formation fluid produced through the passage 41 may be discharged through the wellhead to a collection facility 400, such as a storage tank within a battery.

In operation, formation fluid flows from the subterranean formation 10, into the downhole wellbore zone 16, and through the formation fluid-conducting apparatus 32, in response to at least: (i) reservoir pressure within the subterranean formation, and (ii) inducement by the pump suction 42. The formation fluid is conducted through the formation fluid-conducting fluid passage 30 of the formation fluid-conducting apparatus 32 (such as, for example, along directional arrows 2), and discharged through the formation fluid-conducting fluid passage outlet 31 and into the uphole wellbore zone 14. Within the uphole wellbore zone 14, separation of gaseous formation fluid material from the discharged formation fluid, in response to buoyancy forces, is effected such that a gaseous material-depleted formation fluid is produced. In this respect, within the uphole wellbore zone, the discharged density-reduced formation fluid is separated into the gaseous formation fluid material and the gaseous material-depleted formation fluid. The gaseous formation fluid material is conducted uphole to the wellhead 46, through the annulus 52 disposed between the downhole pumping apparatus 22 and the casing 18 (such as, for example, along directional arrows 4), and is then discharged from the wellbore 12 to the surface and collected. The gaseous material-depleted formation fluid flows downwardly (such as, for example, along directional arrow 6) is received by the pump suction 42 (such as, for example, by flow along directional arrow 8), energized, discharged into the production fluid passage 41, and conducted (such as, for example, along directional arrow 9 to the surface and collected.

2. Artificial Lift System with Gas Lift Apparatus and Downhole Pumping Apparatus In another aspect, and referring to FIG. 9, there is provided an artificial lift system 120 configured for disposition within a wellbore 112, with the wellbore 112 including an uphole wellbore zone 114 and a downhole wellbore zone 116. The uphole and downhole wellbore zones 114, 116 are disposed within the casing 118. The artificial lift system 120 includes a gas lift apparatus 122 and a downhole pumping apparatus 124. The gas lift apparatus 122 is configured for supplying formation fluid to the downhole pumping apparatus 124.

The gas lift apparatus 122 includes a first tubing 126, a second tubing 128, a gaseous material-conducting fluid passage 130, an outlet 142, a density-reduced formation fluid-discharging outlet 132, and a fluidic isolation device 134.

The second tubing 128 is disposed within the first tubing 126. In some embodiments for example, the second tubing 128 is nested within the first tubing 126. In some embodiments, for example, the second tubing 128 is disposed concentrically within the first tubing 126.

The gaseous material-conducting fluid passage 130 is provided for conducting gaseous material. The gaseous material-conducting fluid passage 130 includes a downhole gaseous material-conducting fluid passage 136. The downhole gaseous material-conducting fluid passage is defined by an annulus 140 disposed between the first tubing 126 and the second tubing 128.

The downhole gaseous material-conducting fluid passage outlet 142 is fluidly coupled to the downhole gaseous material-conducting fluid passage 136. The outlet 142 is configured for discharging the conducted gaseous material to effect contacting between the discharged gaseous material and formation fluid disposed within the downhole wellbore zone 116. The contacting between the discharged gaseous material and formation fluid effects production of a density-reduced formation fluid.

The second tubing 128 includes a density-reduced formation fluid-conducting fluid passage 144. The density-reduced formation fluid-conducting fluid passage 144 is disposed for conducting the produced density-reduced formation fluid. The produced density-reduced formation fluid can be flowed through the density-reduced formation fluid-conducting fluid passage 144 in response to at least reservoir pressure of the subterranean formation. The density-reduced formation fluid-conducting fluid passage includes an inlet 146 disposed in sufficient proximity to the outlet 142 of the downhole gaseous material-conducting fluid passage 136 such that the density-reduced formation fluid-conducting fluid passage inlet 146 is disposed for receiving the density-reduced formation fluid.

The density-reduced formation fluid-discharging outlet 132 is disposed in fluid communication with the density-reduced formation fluid-conducting fluid passage 144 for receiving and discharging the density-reduced formation fluid (conducted by the density-reduced formation fluid-conducting fluid passage) into the uphole wellbore zone 114.

The fluidic isolation device 134 is provided for preventing flow of the gaseous material-depleted formation fluid from the uphole wellbore zone 114 to the downhole wellbore zone 116.

In some embodiments, for example, the gas lift apparatus 122 further includes an uphole gaseous supply conduit 148 and a fluid flow connector 150.

The uphole gaseous material-conducting conduit 148 includes an uphole gaseous material-conducting fluid passage 152 disposed in fluid communication with the downhole gaseous material-conducting fluid passage 136. Fluid communication is effected for conducting gaseous material from the passage 152 to the downhole gaseous material-conducting fluid passage 136 by the fluid flow connector 150. In this respect, the gaseous material-conducting fluid passage 130 includes the uphole gaseous material-conducting fluid passage 152. In some embodiments, for example, the uphole gaseous material-conducting conduit 148 extends from the wellhead.

Figure 10:
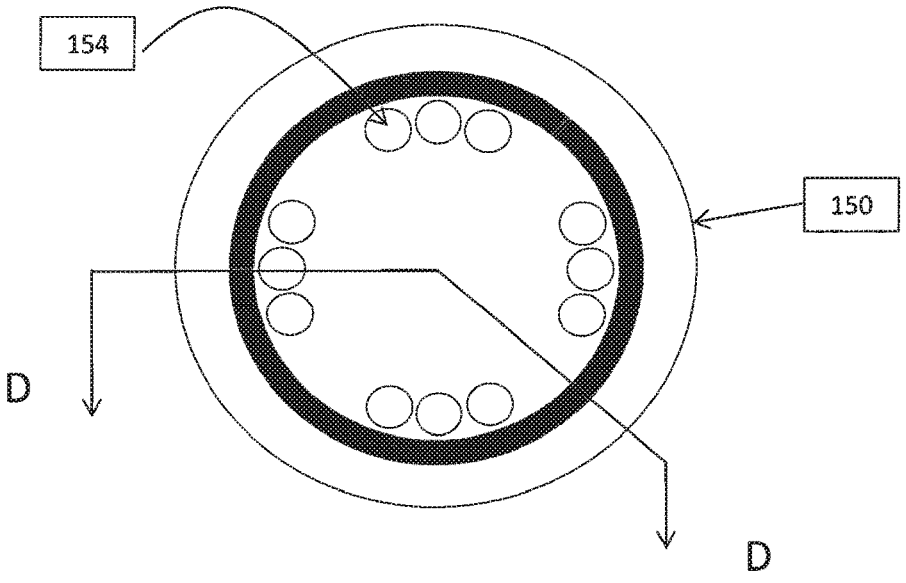
FIG. 10 is a top plan view of an embodiment of the connector of the artificial lift apparatus of the lift system illustrated in FIG. 9.
Figure 11:
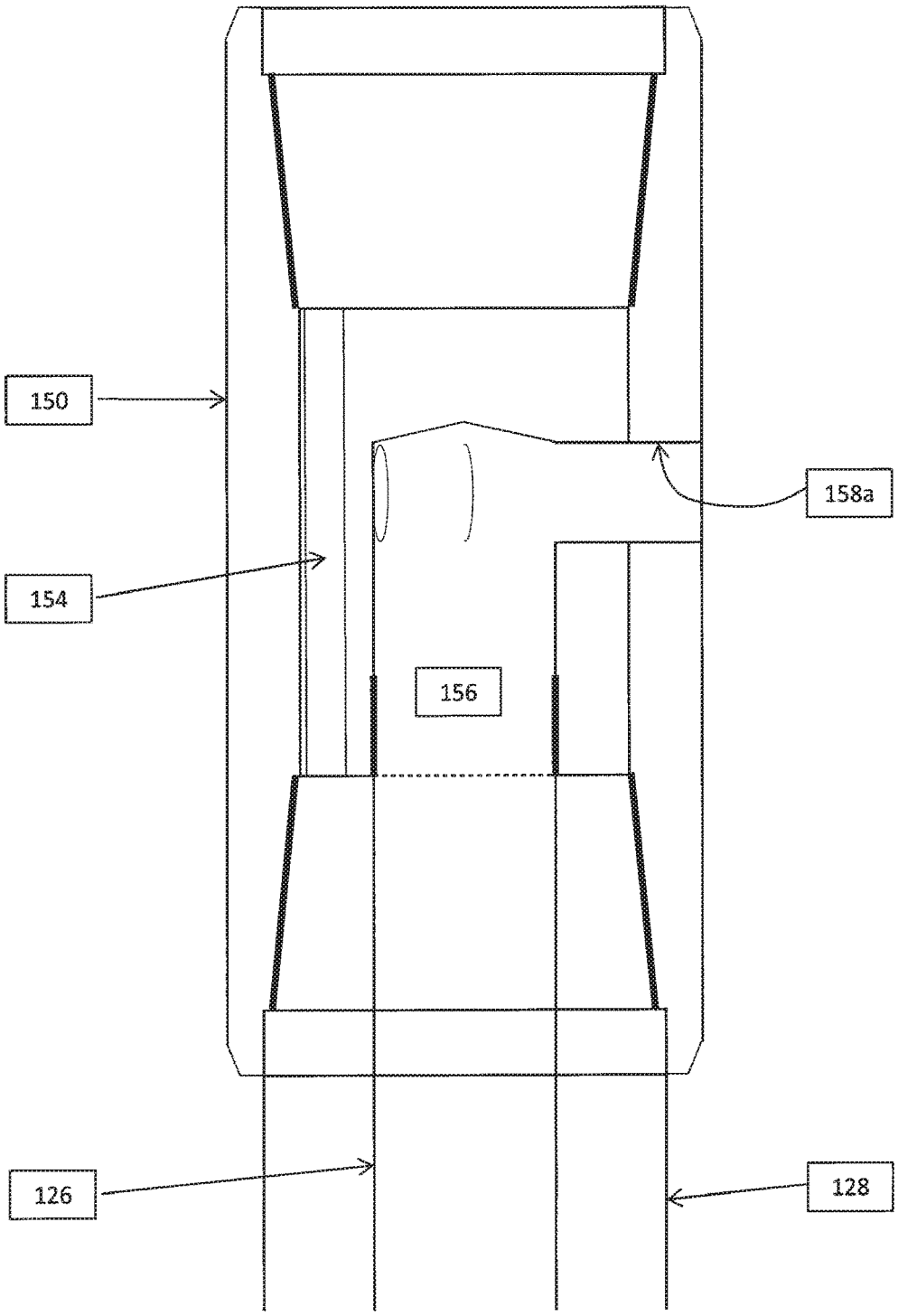
FIG. 11 a sectional elevation view, taken along lines D-D in FIG. 8, of the connector in FIG. 10.

Referring to FIGS. 10 and 11, the fluid flow connector 150 includes a first fluid flow passage 154 and a second fluid flow passage 156. The first fluid passage 154 effects fluid coupling between the uphole gaseous material-conducting fluid passage 152 and the downhole gaseous material-conducting fluid passage 136. The second fluid flow passage 156 effects fluid coupling between the density-reduced formation fluid-conducting fluid passage 144 and the outlet 132. In some embodiments, for example, each one of the first fluid flow passage 154 and the second fluid flow passage 156 is defined by a respective bore that is disposed within the fluid flow connector 150. In some embodiments, for example, the first fluid flow passage 154 is fluidically isolated from the second fluid flow passage 156. In some embodiments, for example, the first and second fluid flow passages 154, 156 are machined within the connector 150.

In some embodiments, for example, the fluid flow connector 150 includes a plurality of ports 158*a*, 158*b*, 158*c* and 158*d* (only one is shown in FIG. 11), disposed in 90 degree relationship relative to one another, for defining the outlet 132.

In some embodiments, for example, the gas lift apparatus 122 further includes a fluid flow apparatus 160. The fluid flow apparatus 160 includes the first and second tubings 126, 128. The fluid flow apparatus 160 is connected to the fluid flow connector 150 such that: (i) fluid communication is effected between the downhole gaseous material-conducting fluid passage 136 and the first fluid passage 154, and (ii) fluid communication is effected between the density-reduced formation fluid-conducting fluid passage 144 and the second fluid flow passage 156. The uphole gaseous supply conduit 148 is connected to the fluid flow connector 150 such that fluid communication is effected between the uphole gaseous material-conducting fluid passage 152 and the first fluid flow passage 154. In this respect, the fluid coupling between the uphole gaseous material-conducting fluid passage 152 and the downhole gaseous material-conducting fluid passage 136 is effected via the first fluid flow passage 154, and the fluid coupling between the density-reduced formation fluid-conducting fluid passage 144 and the outlet 132 is effected via the second fluid flow passage 156.

Figure 9:
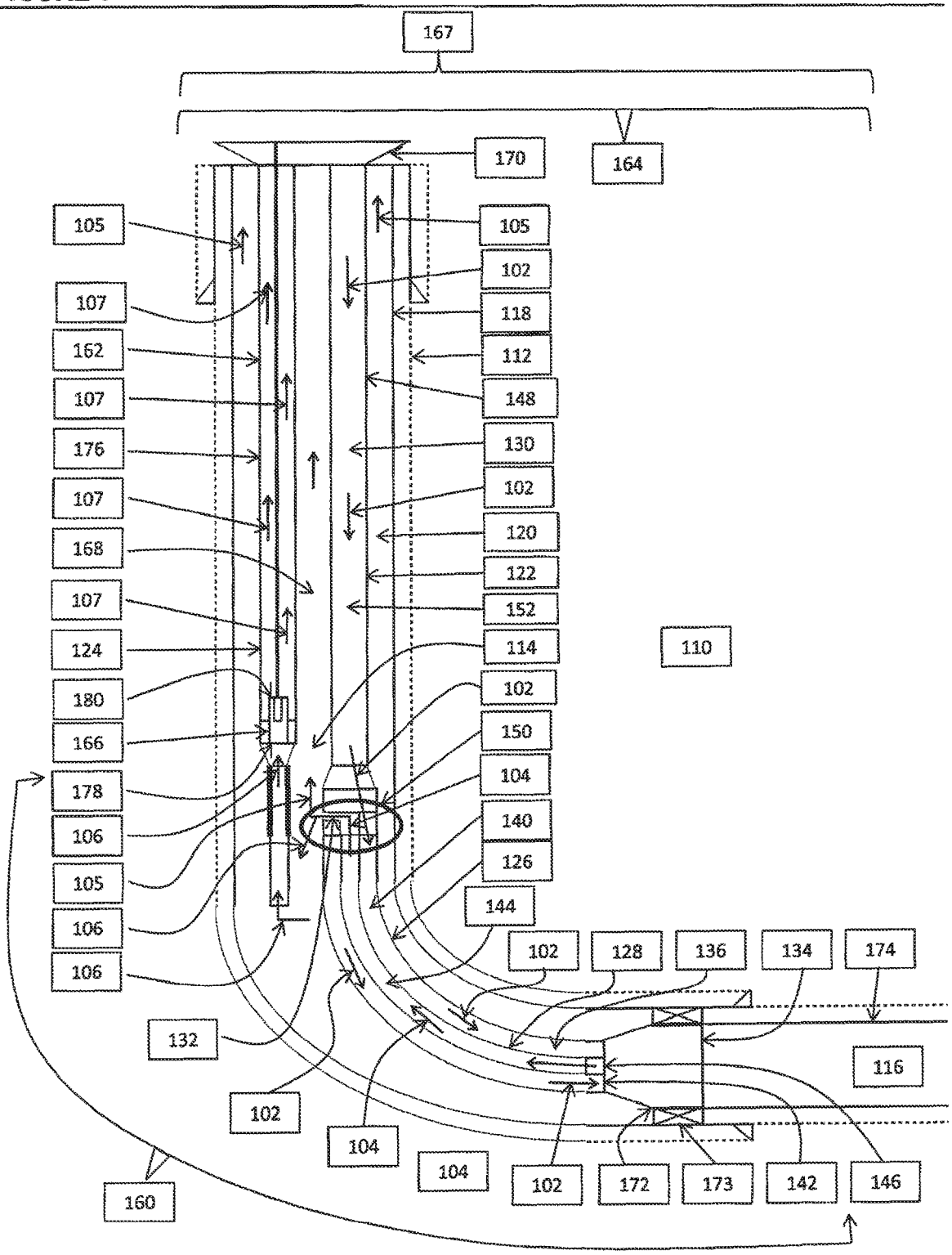
FIG. 9 is a schematic illustration of an embodiment of an artificial lift system of the present disclosure using a downhole pump and a gas lift apparatus.

The gas lift apparatus 122 may be deployed with a downhole pumping apparatus 162 within a wellbore 112 to provide an artificial lift system 164, as illustrated in FIG. 9. In this respect, a system 167 is provided including an artificial lift apparatus 164. The artificial lift apparatus 164 includes the gas lift apparatus 122, described above, and the downhole pumping apparatus 162.

The downhole gaseous material-conducting fluid passage outlet 142 is disposed to supply gaseous material to effect contacting between the supplied gaseous material and formation fluid disposed within the downhole wellbore zone 116. The contacting between the discharged gaseous material and formation fluid effects production of a density-reduced formation fluid.

The artificial lift apparatus 164 is co-operatively disposed relative to the wellbore 12 such that the pump 166, of the downhole pumping apparatus 162, is disposed for inducing flow of the formation fluid to the formation fluid-conducting fluid passage 144. The flowing is also effected, at least in part, in response to reservoir pressure within the subterranean formation 110.

The density-reduced formation fluid-conducting fluid passage inlet 146 is disposed in sufficient proximity to the outlet 142 of the downhole gaseous material-conducting fluid passage 136 such that the density-reduced formation fluid-conducting fluid passage inlet 146 is disposed for receiving the produced density-reduced formation fluid. The density-reduced formation fluid-conducting fluid passage 144 is disposed for conducting the produced density-reduced formation fluid. By virtue of the fluid communication between the density-reduced formation fluid-conducting fluid passage 144 and the gas lift apparatus outlet 132, the gas lift apparatus outlet 132 is disposed for receiving and discharging the density-reduced formation fluid (conducted by the density-reduced formation fluid-conducting fluid passage 144) into the uphole wellbore zone 114.

The uphole wellbore zone 114 includes a gas separation zone within which separation of separated gaseous material from the discharged density-reduced formation fluid, in response to buoyancy forces, is effected such that a gaseous material-depleted formation fluid is produced. In some embodiments, for example, the gas separation zone is disposed within an annulus 168 defined between the casing 118, the downhole pumping apparatus 162 and the gas lift apparatus 122. In this respect, within the gas separation zone, the discharged density-reduced formation fluid is separated into the separated gaseous fluid material and the gaseous material-depleted formation fluid. The gaseous formation fluid material is conducted uphole to the wellhead 170, through the annulus 168 (such as, for example, along directional arrows 105), and is then discharged from the wellbore 112 through the wellhead 170.

Referring to FIG. 12, the gaseous formation fluid material may be discharged from the wellhead 46 and conducted via conduits 304 and 310 to a collection facility 400, such as storage tanks within a battery. Prior to supply to the collection facility 400, the discharged gaseous formation fluid material may be energized, such as by a compressor 306, or by the venturi effect imparted within an ejector (or eductor) 308. In some embodiments, for example, at least a fraction of the discharged gaseous formation fluid material is returned to the wellhead 170 to form gaseous material that is supplied to the wellbore 112 through fluid passage 130.

The fluidic isolation device 134 is disposed between the uphole wellbore zone 114 and the downhole wellbore zone 116 for preventing, or substantially preventing, flow of the gaseous material-depleted formation fluid (that is separated from the discharged density-reduced formation fluid) from the uphole wellbore zone 114 to the downhole wellbore zone 116.

In some embodiments, for example, the fluidic isolation device 134 includes a packer 173, and the packer is disposed in sealing engagement with the casing.

In some embodiments, for example, and as particularly illustrated in FIG. 9, the fluidic isolation device 134 includes a sealing member 172, and the formation fluid-conducting apparatus is disposed or "stung" into the liner string 174, such that the sealing member 172 is disposed in sealing engagement, or substantially sealing engagement, with the liner string 174.

In some embodiments, for example, the fluidic isolation device 134 includes a sealing member, and the sealing member is disposed in sealing engagement, or substantially sealing engagement, with the casing, such as a constricted portion of the casing.

The downhole pumping apparatus 162 includes the pump 166 and production string 176 (or production conduit). The pump 166 is disposed for inducing flow of formation fluid through the density-reduced formation fluid-conducting fluid passage 144. The pump 166 includes a suction 178 for receiving a gaseous material-depleted formation fluid from the uphole wellbore zone 114, and a discharge 180 for discharging pressurized gaseous material-depleted formation fluid.

The production string 176 is disposed in fluid communication with the discharge 180 of the pump 166 and is configured for extending uphole, relative to the pump 166, to the wellhead 170, for flowing the pressurized gaseous material-depleted formation fluid to the wellhead 170.

The pump 166 is disposed for receiving the separated gaseous material-depleted formation fluid and energizing the received gaseous material-depleted formation fluid. The energized formation fluid is discharged from the pump 166 through the discharge 180 and into the production conduit 176. The production conduit 176 is disposed to deliver the energized formation fluid to the surface through the wellhead 170.

Referring to FIG. 9, in operation, formation fluid flows from the subterranean formation and into the downhole wellbore zone 116 in response to at least: (i) reservoir pressure within the subterranean formation, and (ii) inducement by the pump suction 178. Gaseous material is supplied through the gaseous material-conducting fluid passage 130 to the downhole wellbore zone 116 (such as, for example, along directional arrows 102). The gaseous material is contacted (e.g. admixed) with the formation fluid within the downhole wellbore zone 116 to produce a density-reduced formation fluid. The density-reduced formation fluid is flowed through the density-reduced formation fluid-conducting fluid passage inlet 146 and conducted through the density-reduced formation fluid-conducting fluid passage 144 to the gas lift apparatus outlet 132 (such as, for example, along directional arrows 104) and discharged from the outlet 132 into the uphole wellbore zone 114, in response to at least: (i) reservoir pressure within the subterranean formation 10, and (ii) inducement by the pump suction 178. While disposed in the uphole wellbore zone 114, gaseous material is separated from the discharged density-reduced formation fluid, in response to buoyancy forces, such that a gaseous material-depleted formation fluid is produced. In this respect, within the uphole wellbore zone 114, the discharged density-reduced formation fluid is separated into the gaseous material and the gaseous material-depleted formation fluid. The gaseous material is conducted uphole to the wellhead 170, through the annulus 168 (such as, for example, along directional arrows 105), and is then discharged from the wellbore 112 to the surface and collected. The gaseous material-depleted formation fluid is flowed to (such as, for example, along directional arrows 106) and received by the pump suction 178, energized, discharged into the production conduit 176, and conducted (such as, for example, along directional arrows 107) to the surface and collected.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. An artificial lift system disposed within a wellbore, the wellbore comprising an uphole wellbore zone and a downhole wellbore zone, comprising:

a flow diverter body comprising:

a housing;

a first inlet port configured to receive at least reservoir fluids;

a plurality of first outlet ports disposed in an uphole facing surface of the housing, the first outlet port configured to discharge received reservoir fluid;

a plurality of reservoir fluid-conducting passages extending through the housing, wherein each one of the reservoir fluid-conducting passages independently extends from a respective first outlet port and is disposed in fluid communication with the first inlet port, such that the plurality of first outlet ports is fluidly coupled to the first inlet by the plurality of reservoir fluid-conducting passages;

a plurality of second inlet ports, disposed in a downhole facing surface of the housing and positioned relative to the first outlet port such that, when the flow diverter is disposed within the wellbore and oriented for receiving at least reservoir fluids via the first inlet port, wherein each of the second inlet ports, independently, is disposed downhole relative to the plurality of first outlet ports;

a second outlet port disposed in the uphole facing surface of the housing, wherein each one of the first outlet ports is disposed peripherally relative to the second outlet port; and a plurality of gas-depleted fluid conducting passage extending through the housing, wherein each one of the gas-depleted fluid conducting passages independently extends from a respective second inlet port and is disposed in fluid communication with the second outlet port, such that the plurality of second inlet ports is fluidly coupled to the second outlet port by the plurality of gas-depleted fluid conducting passages;

wherein the uphole wellbore zone comprises a gas separation zone within which separation of gaseous material from the received reservoir fluid that is discharged from the first outlet port, in response to buoyancy forces, is effected such that a gaseous material-depleted reservoir fluid is produced;

a sealed interface disposed between the uphole wellbore zone and the downhole wellbore zone, the sealed interface configured to prevent, or substantially prevent, flow of gaseous material-depleted reservoir fluid from the uphole wellbore zone to the downhole wellbore zone; and a downhole pumping apparatus comprising:

a pump, disposed for inducing flow of reservoir fluid through the flow diverter, the pump comprising a pump inlet configured to receive the gaseous material-depleted reservoir fluid from the second outlet port of the flow diverter body, and a pump discharge configured to discharge pressurized gaseous material-depleted reservoir fluid; and a production fluid passage disposed in fluid communication with the discharge and extending uphole, relative to the pump, to a wellhead, the production fluid passage configured to flow the pressurized gaseous material-depleted reservoir fluid to the wellhead;

wherein, while the flow diverter is disposed within the wellbore, each one of the first outlet ports, independently, is oriented uphole, such that an axis of the respective first outlet port is disposed at an angle of less than 45 degrees relative to a vertical, wherein each one of the first outlet ports, independently, is facing a space that is disposed uphole relative to the flow diverter, and wherein each one of the first outlet ports, independently, is disposed for discharging the received at least reservoir fluids into the wellbore.

2. The artificial lift system as claimed in claim 1, wherein the first outlet port is disposed out of alignment with the pump.

3. The artificial lift system as claimed in claim 1; further comprising a casing disposed within the wellbore;

wherein the uphole and downhole wellbore zones are disposed within the casing;

and wherein the sealed interface includes a sealing member that is disposed in sealing engagement with the casing.

4. The artificial lift system as claimed in claim 1, wherein the first inlet port is disposed on the downhole facing surface.

5. The artificial lift system as claimed in claim 4, wherein the downhole facing surface and the uphole facing surface are perpendicular to a longitudinal axis of the flow diverter.

* * * * *